United States Patent [19]

Sekozawa et al.

[11] Patent Number: 5,041,981

[45] Date of Patent: Aug. 20, 1991

[54] ELECTRIC CONTROL APPARATUS FOR AUTOMOBILE AND METHOD OF COMPENSATING FOR TIME DELAY OF MEASURED DATA

[75] Inventors: Teruji Sekozawa, Kawasaki; Motohisa Funabashi, Sagamihara, both of Japan

[73] Assignee: Hitachi, Ltd., Tokyo, Japan

[21] Appl. No.: 363,879

[22] Filed: Jun. 9, 1989

[30] Foreign Application Priority Data

Jun. 10, 1988 [JP] Japan ..... 63-144524

[51] Int. Cl.[5] ..... F02B 3/04

[52] U.S. Cl. ..... 364/431.05; 364/431.07

[58] Field of Search ..... 364/431.05, 431.07, 364/431.04; 123/418, 419

[56] References Cited

U.S. PATENT DOCUMENTS

| | | | |
|---|---|---|---|
| 4,424,568 | 1/1984 | Nishimura et al. | 364/431.05 |
| 4,479,186 | 10/1984 | Takao et al. | 364/431.05 |
| 4,547,852 | 10/1985 | Kamifuji et al. | 364/431.07 |
| 4,604,703 | 8/1986 | Hasegawa | 364/431.05 |

FOREIGN PATENT DOCUMENTS

| | | |
|---|---|---|
| 59-068543 | 4/1984 | Japan . |
| 59-101556 | 6/1984 | Japan . |
| 59-231150 | 12/1984 | Japan . |
| 60-060234 | 4/1985 | Japan . |
| 61-272470 | 12/1986 | Japan . |
| 63-131840 | 6/1988 | Japan . |

*Primary Examiner*—Parshotam S. Lall
*Assistant Examiner*—Gary D. Yacura
*Attorney, Agent, or Firm*—Antonelli, Terry, Stout & Kraus

[57] ABSTRACT

An apparatus for and method of compensating time delay of measured data in an electric control unit for an automobile which has a measuring unit for measuring a data value representing at least one state of a controllable device mounted on the automobile and an operation processing unit for calculating at least one control value to be applied to the controllable device on the basis of output data values of the measuring means. Successive output data values of the measuring unit are stored in a memory unit. An estimation value representing the one state of the controllable device at a future time point is calculated at a current time point on the basis of an output data value of the measuring unit at a current time point and at least one output data value previously stored in the memory unit. The operation processing unit calculates the control value on the basis of the estimation value to thereby compensate for a data delay for the measuring unit.

27 Claims, 16 Drawing Sheets

| MEMORY AREA / TIME k | $Q_A$ | $Q_B$ | $Q_C$ |
|---|---|---|---|
| 1 | $Q_{(1)}$ | $Q_{(1)}$ | $Q_{(1)}$ |
| 2 | $Q_{(2)}$ | $Q_{(1)}$ | $Q_{(1)}$ |
| 3 | $Q_{(3)}$ | $Q_{(2)}$ | $Q_{(1)}$ |
| ⋮ | ⋮ | ⋮ | ⋮ |
| n-1 | $Q_{(n-1)}$ | $Q_{(n-2)}$ | $Q_{(n-3)}$ |
| n | $Q_{(n)}$ | $Q_{(n-1)}$ | $Q_{(n-2)}$ |

ELECTRIC CONTROL APPARATUS FOR AUTOMOBILE AND METHOD OF COMPENSATING FOR TIME DELAY OF MEASURED DATA

BACKGROUND OF THE INVENTION

The present invention relates to an electric control apparatus for processing data measured with various sensors and controlling an engine and/or suspension of an automobile on the basis of the processed data, and more particularly to an apparatus for and method of compensating for a time delay of measured data.

In a conventional electric control apparatus for an engine and/or suspension of a vehicle, such as an automobile, data measured with various sensors is picked up at an interval of a constant time or constant rotary angle (i.e., rotary angle of the crank shaft), and the picked up data is averaged, e.g., by means of weighted averaging, within a predetermined section (e.g., within a predetermined time duration or predetermined rotary angle range), and is processed for removal of noises by means of a primary delay filter or the like, to effect smoothing of pulsation of suction air to the engine, and to other processings. The electric control apparatus of this type is disclosed in, e.g., Japanese Patent Laid-open Publication JP-A-58-8239.

The engine conditions of an automobile change from time to time while measuring engine running data. Therefore, it becomes necessary to control fuel injection, ignition advance angle and the like in order to deal with such a change, especially a rapid change of the engine conditions. However, the control operation will be delayed due to a time delay at a filter used for noise removal, a time delay at a sensor while converting a physical value into an electrical value, and a time delay required for processing data at the electrical control apparatus of is automobile.

Such a delay in the control operation will be described with reference to FIGS. 1 and 2. FIG. 1 is a graph showing a relationship between a throttle opening angle (degree) of a throttle valve and a flow rate Q of suction air to the engine, and FIG. 2 is a graph showing the control characteristic of an air/fuel ratio of a gas mixture in the engine when rapidly opening the throttle valve under control of a conventional control apparatus.

FIG. 1 shows a characteristic curve (a) of measured data obtained when rapidly opening a throttle valve as shown by a curve (c), wherein the flow rate of suction air to the engine is measured with an air flow sensor, such as a hot-wire type air flow meter, and the measured data is passed through a filter, such as an RC circuit, in the manner as will be described later and thereafter A/D converted. A curve (b) represents an actual flow rate of suction air to the engine. It is to be noted that the measured data exhibits a delay from the actual flow rate because of a delay in the air flow meter, RC circuit and the like. Therefore, if a fuel corresponding in amount to an air flow rate measured at the time of rapid opening of the throttle valve is injected for the purpose of obtaining a target air/fuel ratio, e.g., of 14.7, the resultant air/fuel ratio takes a value shifted from the target value 14.7 as shown in FIG. 2 because of a delay of the measured air flow rate. Therefore, there arises the phenomenon that the air flow rate becomes lean at the start of acceleration (at the time of increasing the air flow rate), whereas it becomes rich during a short period at the end of acceleration.

As described above, there arises the problem that a correct control cannot be ensured during a rapid engine condition change if actuators (e.g., the fuel injection valve and the like) are controlled in accordance with manipulatory values calculated based on the averaged or smoothed, measured data.

As disclosed in Japanese Patent Laid-open Publications JP-A-63-131840 and JP-A-63-131841, in an engine control apparatus which calculates a fuel injection time on the basis of an output from a pressure sensor for measuring the pressure in an intake tube, the pulsation component of a pressure output signal from the pressure sensor is removed with a filter having a relatively large time constant. In order to compensate for a delay of the fuel injection control caused by a delay of the measured pressure data, a reference fuel injection time duration at a current time point is adjusted based on a difference between the reference fuel injection time duration at the current time point and the reference fuel injection time duration calculated one period earlier, and based on other parameters. A fuel injection time duration is calculated based on the data supplied from a plurality of sensors, such as pressure sensor data, engine revolution number data and the like. However, this control apparatus operates to compensate for a time delay not of the respective measured data, but of the final manipulatory value. Therefore, the control apparatus cannot satisfactorily follow a rapid change in output data from respective sensors so that the delays in measured data cannot be correctly compensated. For example, in the case where only the pressure in the intake valve changes and the engine rotation number does not change, it is not possible to compensate for the measured pressure data only. Consequently, a correct engine control is not possible leading to a hardship of proper engine output control and exhaust gas control.

Further, there is not known a conventional electric control apparatus for a suspension which can compensate for a delay of measured data from a dumper stroke sensor or the like, resulting in a hardship of correctly controlling a suspension upon a rapid change of road conditions.

SUMMARY OF THE INVENTION

It is an object of the present invention to provide a method of and apparatus for compensating for a time delay of data measured with various sensors, in an electric control apparatus for an engine and/or suspension of a vehicle such as an automobile.

The above object is achieved, in an electric control apparatus for controlling a controllable device such as an engine, suspension, etc. based on the results of processing data measured with various sensors, by passing the data measured with sensors through a phase advance (lead) filter prior to the data processing to compensate the measured data itself for a time delay.

A phase advance filter as proposed by the present invention compensates for a delay time, i.e., a time required for processing data after the time when a sensor has measured the data. Specifically, as will be described in connection with various embodiments, the phase advance filter obtains an estimation value for a correct sensor output value at a current time point (or at a current rotary angle position) through calculation of measured data at past time points and the current point. For instance, the estimation value at the current time point (or at the current rotary angle position) is a sum of the measured value at the current time point (or at the current rotary angle position) and a difference between the measured values at the current time point and at the time point one period earlier. The term "period" means a constant time duration or constant rotary angle range, at an interval of which data is picked up. In other words, in accordance with the present invention, a time delay of measured data is compensated by calculating an estimation value of data to be measured at the time point after one period based on the data measured at the current and past time points, and by regarding the calculated estimation value as an actual measured data value at the current time point.

According to another method of calculating an estimation value at a current time point (or at a current rotary angular position), a difference between the measured data values at the current time point (or at the current rotary angular position) and at one period earlier is multiplied by a coefficient derived by using a function of another measured data value, such as an engine revolution number, and the resultant data value is added to the measured data value at the current time point (at the current rotary angular position).

An estimation value thus obtained is substantially equal to the correct sensor output value at the current time point (rotary angular position). An engine and/or suspension is controlled based on the estimation value so that a correct control with good response to a rapid change in engine running conditions and/or road conditions is ensured to thereby improve the engine output characteristic, exhaust gas characteristic and the like.

The measured data may preferably be passed through a phase advance filter only at a transition state of the engine or suspension. Similarly, the measured data may be passed through a phase advance filter only when a change in measured data value increases at a rate larger than or equal to a predetermined rate. With such arrangements, a more correct estimation value can be obtained for various conditions on an engine, suspension, and other vehicle systems.

DESCRIPTION OF THE PREFERRED EMBODIMENTS

Figure 3:
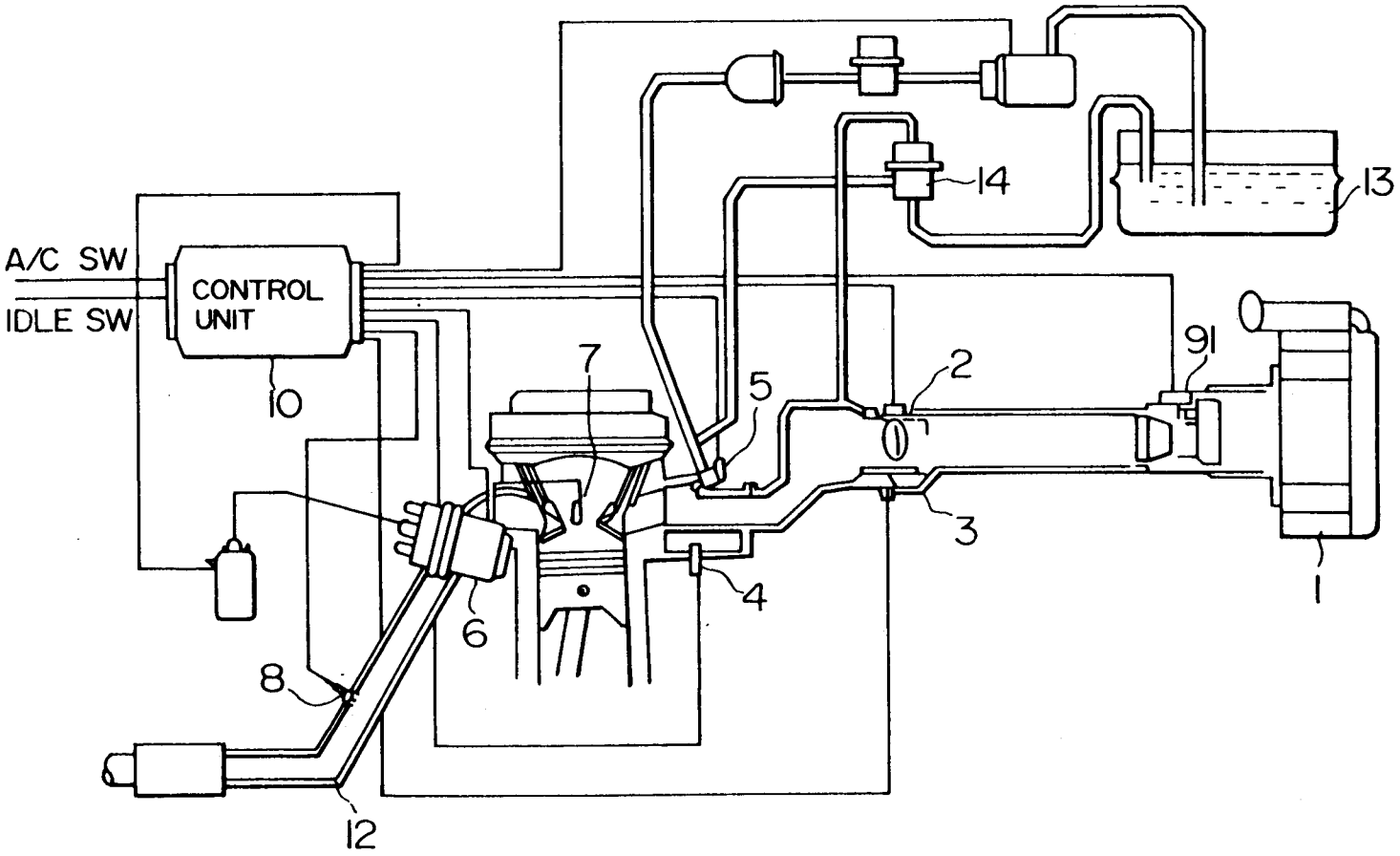
FIG. 3 is a schematic diagram showing the main part of an internal combustion engine of an automobile to which the present invention is applied.

The embodiments of the present invention will be described with reference to the accompanying drawings. FIG. 3 shows a fuel injection system and the like of an internal combustion engine of an automobile to which the present invention is applied.

In FIGS. 3, air enters from an air cleaner 1, passes through an air flow meter, such as a hot-wire type air flow meter (also called an air flow sensor) 91, a throttle valve 2, and a bypass air valve 3, and reaches an injector 5. At the injector 5, fuel supplied from a fuel tank 13 via a fuel pump 14 is injected and mixed with air to be sucked into the combustion chamber. In the combustion chamber, the gas mixture is ignited by an ignition plug and burned. The burning gas passes through an exhaust tube 12 and the air/fuel ratio thereof is measured by an air/fuel ratio sensor 8.

Inputted to a control unit 10 is a signal representative of a suction air flow rate from the air flow meter 91, a signal representative of an air/fuel ratio from the air/fuel ratio sensor 8, a signal representative of the temperature of cooling water from a cooling water temperature sensor 4, a pulse signal outputted from a distributor crank angle sensor 6 every time a crank shaft (not shown) rotates by a predetermined angle, and other signals.

Figure 4:
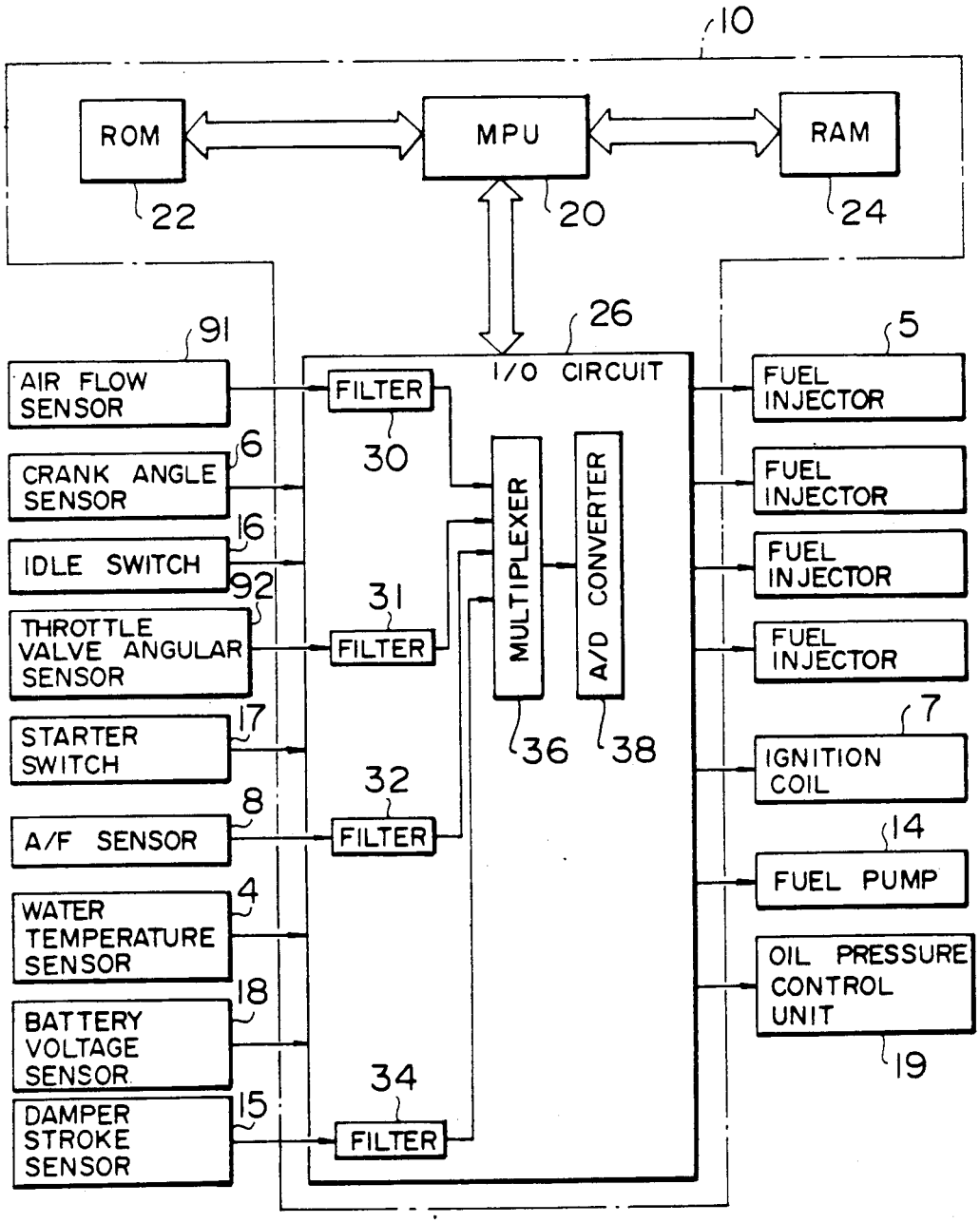
FIG. 4 is a schematic block diagram of the control unit of FIG. 3.

The structure of the control unit 10 is shown in FIG. 4. Devices to be controlled by the control unit 10 include an engine, suspension and the like. Outputs from various sensors mounted on an automobile can be used therefore as the measured data which is subjected to delay compensation according to this invention. In addition to the outputs from the above-described sensors, the control unit 10 may be connected to receive, as shown in FIG. 4, an output signal from a throttle angle sensor 92 for measuring an angular position $\theta$th of the throttle valve, and an output from a dumper stroke sensor 15 for measuring the dumper stroke position of a wheel on the suspension. These outputs from the sensors 4, 6, 8, 15, 91 and 92 represent data indicative of the conditions of the controllable devices. In addition, inputted to the control unit 10 are output signals from an idle switch 16 and starter switch 17, and an output signal from a battery voltage sensor 18. The control unit 10 includes an input/output circuit (simply called an I/O circuit hereinafter) 26 for receiving the outputs from the sensors, a microprocessor unit (called an MPU hereinafter) 20, a read-only memory (called ROM hereinafter) 22, and a random access memory (called RAM hereinafter) 24. In the I/O circuit, the analog outputs from, e.g., the air flow sensor 91, air/fuel ratio sensor 8, dumper stroke sensor 15, throttle angle sensor 92 and etc. are sent to a multiplexer 36 via corresponding primary delay filters 30, 32, 34 and 31 in the form of, e.g., an RC filter for removing signal noises. The multiplexer sequentially selects and sends the inputted signals to an A/D converter 38 at a predetermined period (e.g., predetermined time duration or predetermined rotary angle range). The A/D converted digital data is stored in RAM 24 and is processed by MPU 20.

Figure 5:
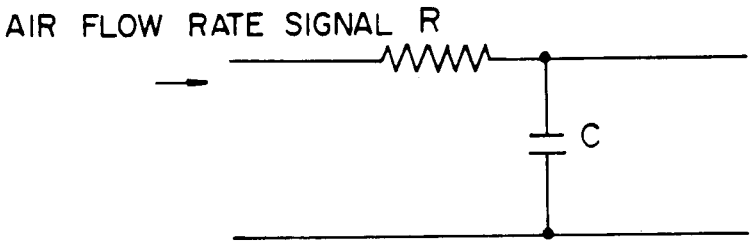
FIG. 5 shows an example of an RC filter.
Figure 6:
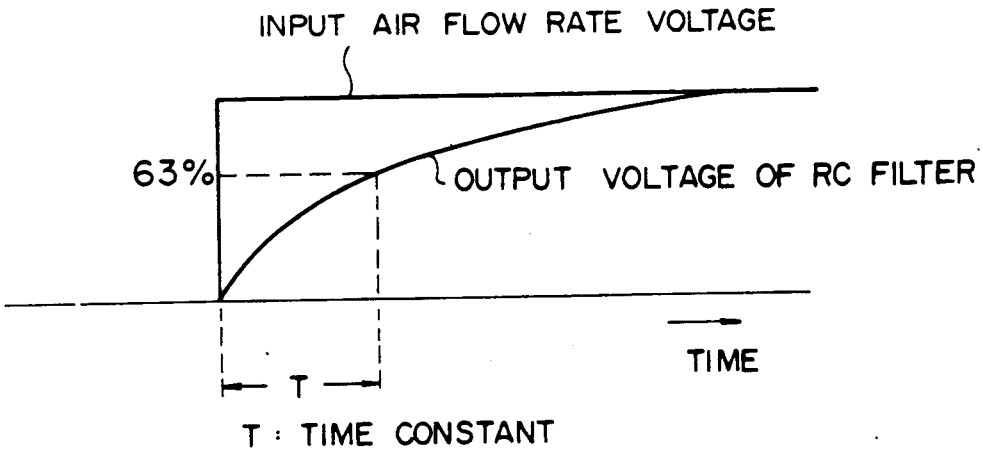
FIG. 6 is a graph showing a response characteristic of an RC filter.

An example of the RC filter circuit is shown in FIG. 5, and the step response characteristic thereof is shown in FIG. 6.

FIG. 6 shows an output voltage from the RC filter circuit when a stepwise voltage (a signal representative of an air flow rate) from the air flow sensor 91 is inputted to the RC filter circuit.

A pulse signal from the crank angle sensor 6 passes through the I/O circuit and is counted, e.g., with a soft counter in RAM 24 to thereby calculate a revolution number of the engine per unit time. The revolution number is stored at a predetermined period in RAM at a predetermined area. Other input signals are processed in a similar manner.

Respective data stored in RAM are subjected to predefined operations, such as calculation for a fuel injection pulse width, ignition timing, dumper stroke position and the like, in accordance with program instructions stored in ROM. The operation results are outputted as commands to the I/O circuit, which in turn outputs control signals to the actuators so that the actuators control the controllable devices, such as the fuel injection valve 5, ignition coil 7, oil pressure control device 19 for controlling the dumper stroke position, and the like.

Figure 2:
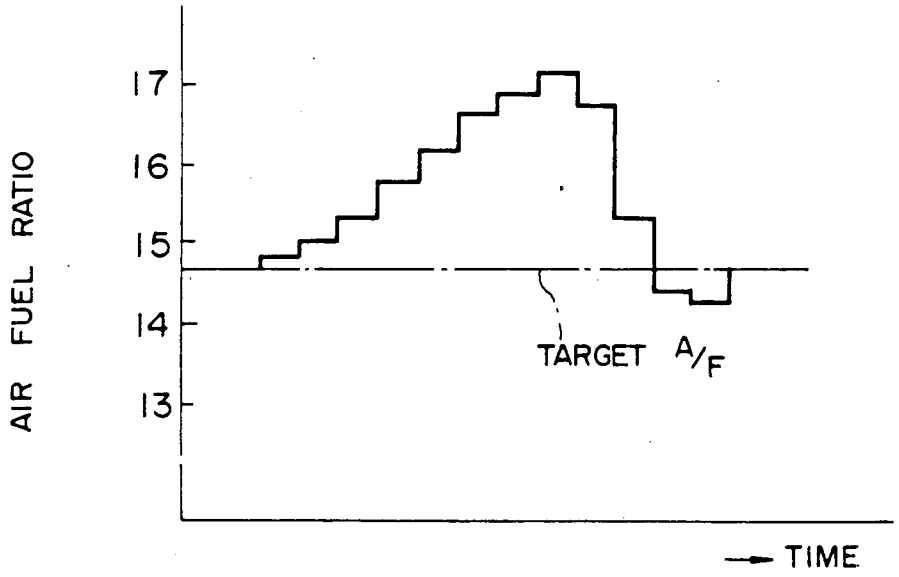
FIG. 2 PRIOR ART
FIG. 2 is a graph showing an air/fuel control characteristic associated with FIG. 1.

The main reason for the deterioration of the air/fuel ratio control characteristic of the control apparatus as shown in FIG. 2 is a time delay from the time when a sensor has measured a data value to the time when MPU 20 processes the data. This time delay is caused by a delay at the sensor itself, a delay at a primary delay filter, a delay at the A/D converter, and the like. For instance, a delay of about 10 to 30 msec is present at an air flow sensor, several tens of msec delay is added at an RC filter, and a delay of about 4 msec is added at the A/D converter.

The first embodiment of this invention for compensating for such a delay will be described with reference to FIGS. 7 to 11.

In this embodiment, an actual measured data value at a current time point is estimated on the assumption that a difference between the measured data value at the current time point and the actual data value measured with a sensor is substantially equal to the change amount of the measured data from the past to the present time. The estimation value is used for compensating for the time delay of the measured data. Specifically, the estimation value for measured data at the time after one period is obtained on the assumption that the change amount of measured data from the past to the present time will continue up to the time after one period, and the estimation value is regarded as the actual measured data value at a current time point to thereby compensate for the time delay.

Figure 7:
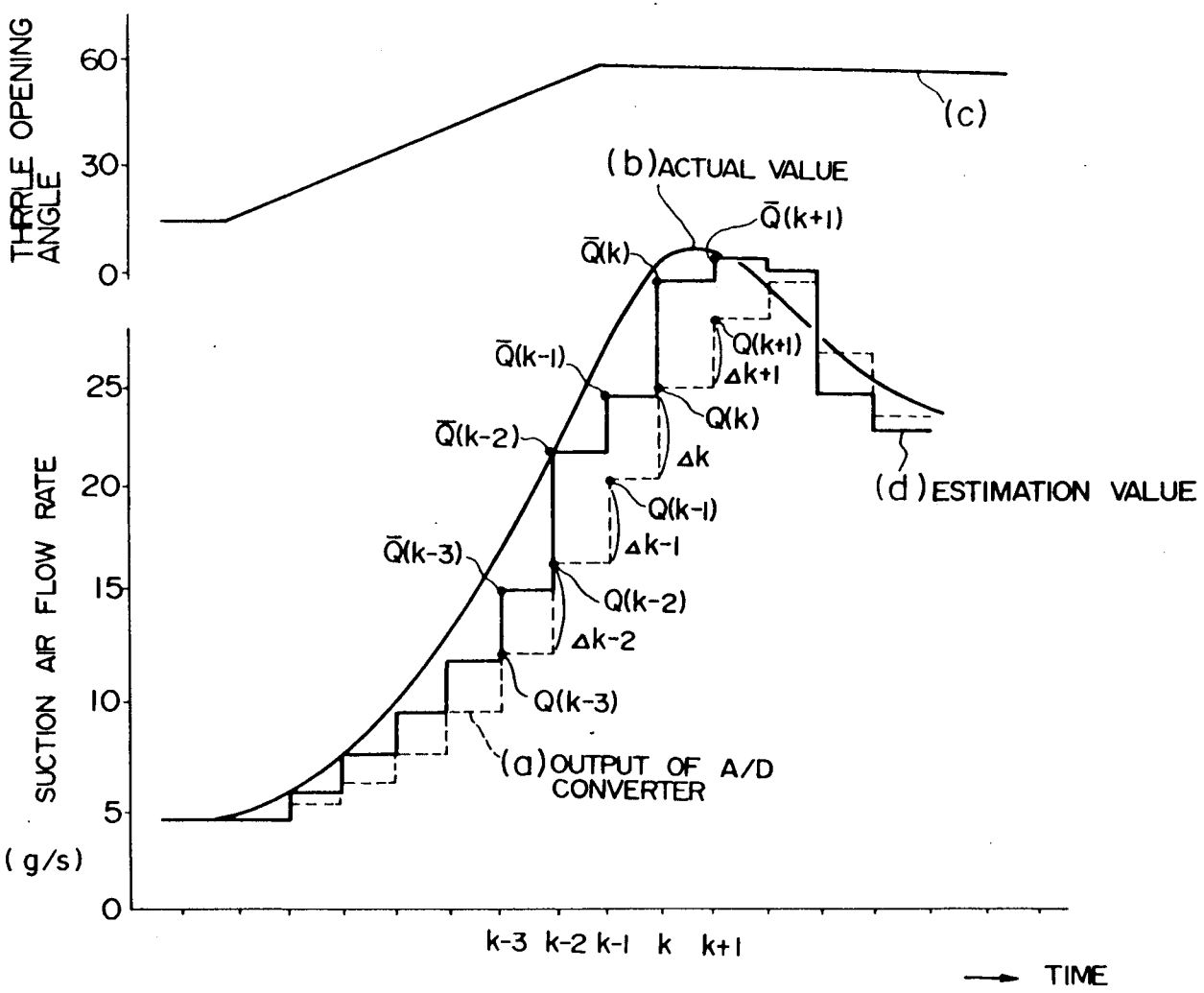
FIG. 7 is a graph showing a relationship between a throttle opening angle and an estimation value of air flow rate data, according to a first embodiment of this invention.

FIG. 7 shows the relationship between an actual (correct) air flow rate (curve (b)) when the throttle valve 2 is rapidly opened as shown by curve (c), output data of the A/D converter 38 (curve (a)), and an estimation value of an air flow rate (curve (d)). In FIG. 7, a current time is represented by k, and the measured data (data before it is processed by MPU, e.g., output data from the A/D converter 38) is represented by Qk, and an estimation value for the actual (correct) air flow rate at the current time point k is represented by $\overline{Q}k$. The method of obtaining $\overline{Q}k$ will be described hereinbelow. The data from the air flow sensor is assumed to be outputted from the A/D converter at a predetermined period (e.g., at a predetermined time duration). The measured data of an air flow rate at a time point k is represented by Q(k), the data at a time point (k−1) by Q(k−1), the data at a time point (k−2) by Q(k−2), and so on. A change of measured data is defined as follows.

$$\Delta_k = Q(k) - Q(k-1) \quad (1)$$

$$\Delta_{k-1} = Q(k-1) - Q(k-2) \quad (2)$$

$$\Delta_{k-2} = Q(k-2) - Q(k-3) \quad (3)$$

A difference between the estimation value $\overline{Q}k$ and the measured data Q(k) at a current time point is represented by:

$$\overline{\Delta}_k = \overline{Q}(k) - Q(k) \quad (4)$$

In this embodiment, the estimation value $\overline{Q}k$ is obtained in accordance with the following criterion:

$$\overline{\Delta}_k = \Delta_k + (\Delta_k - \Delta_{k-1}) \quad (5)$$

This formula assumes that a difference between the measured data value at a current time point and the correct value actually measured with the air flow sensor at the current time point is equal to the sum of the change amount Δk between the current time point and the time point one period earlier and the change rate $(\Delta_k - \Delta_{k-1})$. Specifically, the change rate $(\Delta_k - \Delta_{k-1})$ of the change amount of measured data is assumed to continue up to the time point one period earlier, and the change amount of measured data at the time point one period earlier from the current time point is assumed as the sum of Δk and $(\Delta_k - \Delta_{k-1})$, to thereby estimate the measured data at the time after one period and regard the estimation value as the actual measured data value at the current time point.

The formula for obtaining the estimation value $\overline{Q}k$ is given as follows by developing the formula (5):

$$\overline{Q}(k) = 3Q(k) - 3Q(k-1) + Q(k-2) \quad (6)$$

It is also expressed as:

$$\overline{Q}(k) = Q(k) + \Delta k + (\Delta_k - \Delta_{k-1}) \quad (7)$$

The estimation value $\overline{Q}k$ thus obtained takes a value approximately equal to the actual air flow rate (curve (b)), as shown by curve (d) in FIG. 7. Consequently, by using the estimated air flow rate $\overline{Q}k$ instead of the measured data Q(k) at the current time point for calculating the fuel injection amount and the like, the above-described time delay can be compensated.

Figure 8:
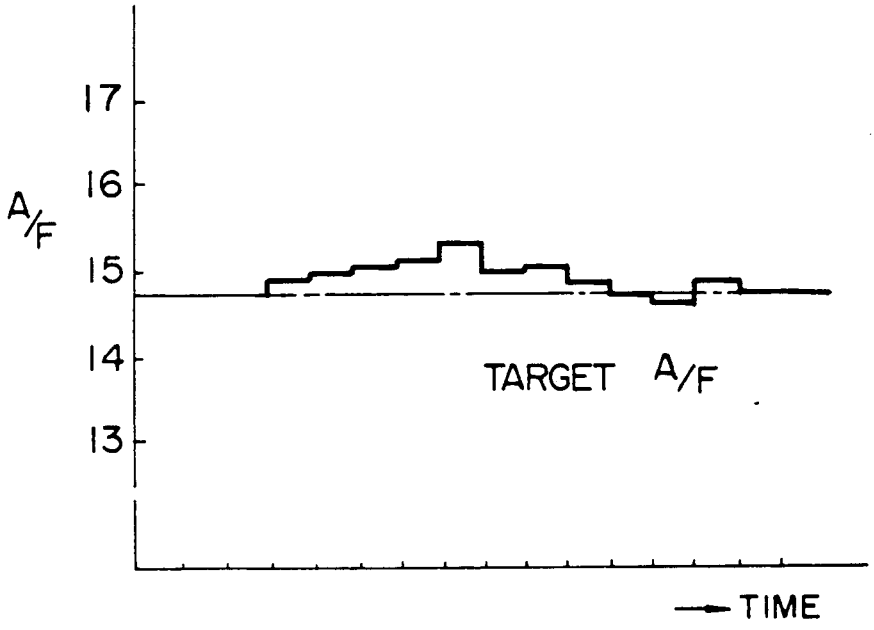
FIG. 8 shows an air/fuel control characteristic associated with FIG. 7.

FIG. 8 shows the air/fuel ratio control characteristic in which fuel is injected so as to obtain a target air/fuel ratio on the basis of the air flow rate estimated as in the above embodiment. It can be seen that the air/fuel ratio control characteristic is considerably improved when compared with that shown in FIG. 2.

Figures 9A, 9B:
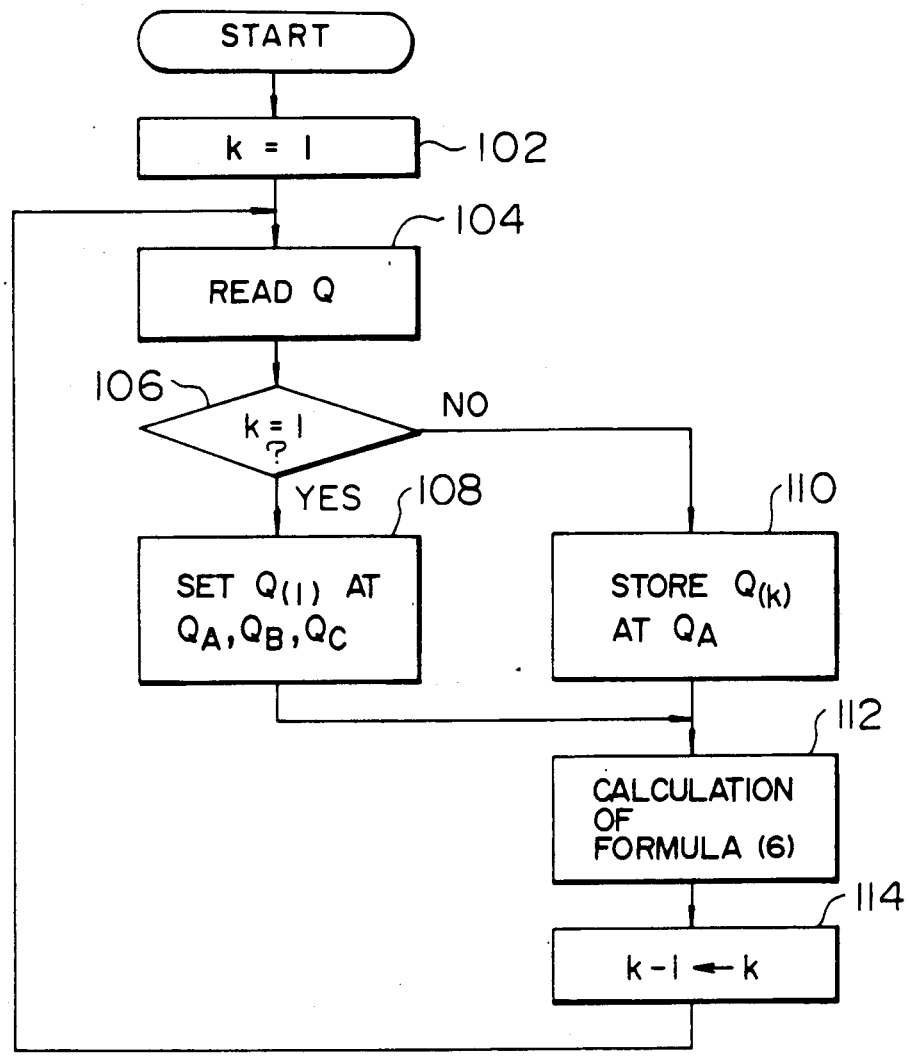
FIG. 9A is a flow chart for illustrating the operation of the first embodiment.
FIG. 9B is a diagram for explaining the data shift operation of the first embodiment.

FIG. 9A shows an example of a flow chart illustrating the calculation of the estimation value in accordance with programs stored in ROM shown in FIG. 4. In this embodiment, it is assumed that the data from the air flow sensor is A/D converted at an interval of a predetermined time, e.g., every 10 msec.

First, upon turning on the power of the electric control apparatus by means of the starter switch 17, each sensor, the control unit 10 and the like are actuated.

At step 102, time k is set as k=1. At step 104, the measured data Q(1) of an air flow rate, for example, from the A/D converter 38 is read every 10 msec. At step 106, since k=1, the flow advances to step 108 in which the read-out data Q(1) is initially set in RAM at a predetermined area. At the initial setting, the data Q(1) is set at predetermined areas QA, QB and QC as shown in FIG. 9B.

Next, at step 112, calculation of the formula (6) is carried out using the data at the areas QA, QB and QC to thereby obtain $\overline{Q}(K)=Q(1)$ which is set in RAM at a different area. Next, at step 114, after a lapse of 10 msec, the value of k is set as k+1, and at step 104 the measured data Q(2) is read. Since k=2, the flow advances to step 110 in which the data Q(2) is stored at area QA, and the data Q(1) at areas QA and QB are shifted to areas QB and QC. Upon calculation of the formula (6), the data at areas QA, QB and QC become in correspondence with Q(k), Q(k−1) and Q(k−2), respectively.

Similar operations are repeated to calculate the data $\overline{Q}(k)$.

Figure 10:
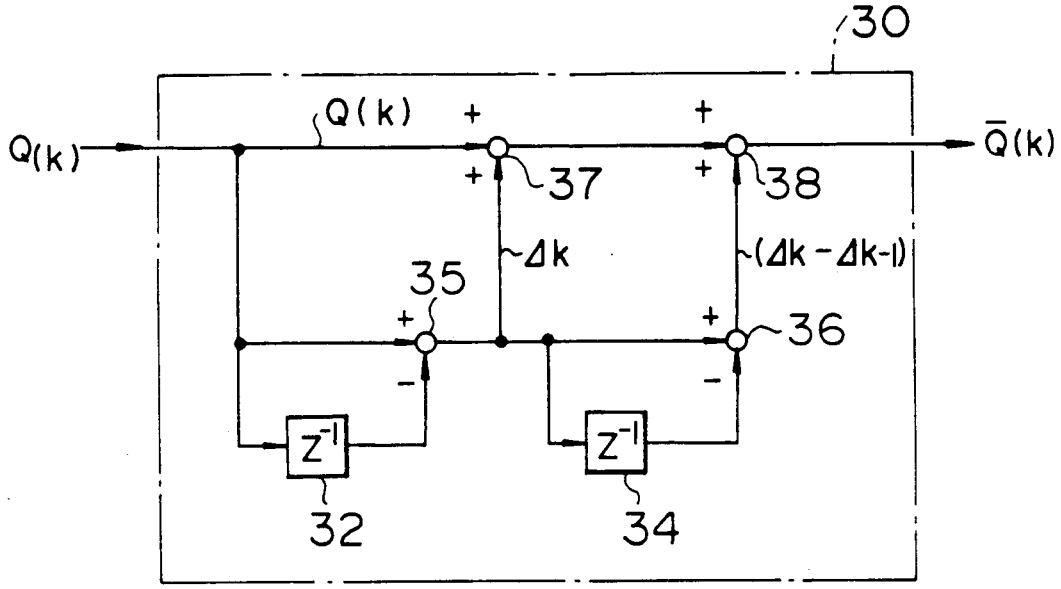
FIGS. 10 and 11 are schematic diagrams of the delay compensation circuit according to the first embodiment.
Figure 11:
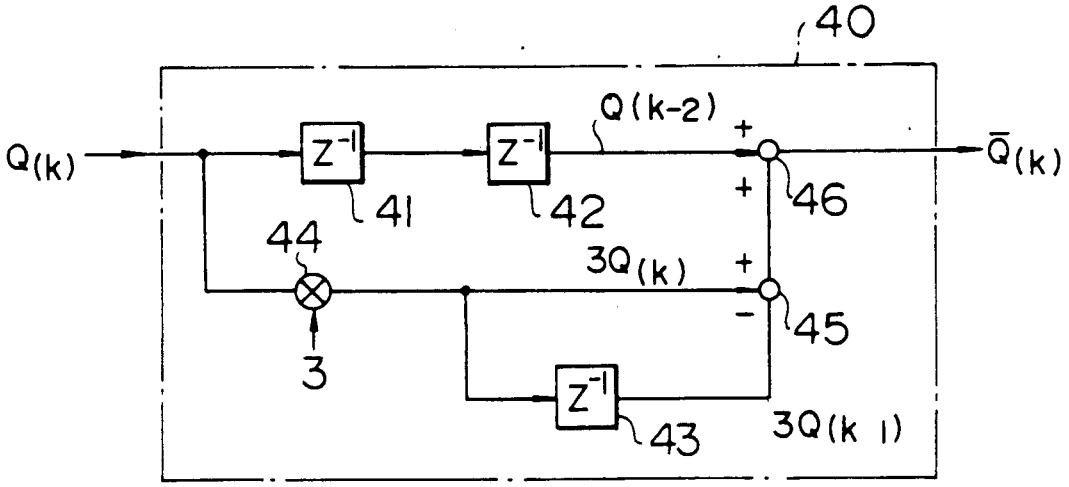

FIGS. 10 and 11 show the schematic arrangement of this embodiment which may be implemented within the I/O circuit 26.

FIG. 10 shows a delay compensation circuit (advance filter) 30 embodying the formula (7). In FIG. 10, reference numerals 32 and 34 represent delay elements for delaying a signal for a time equal to one period, reference numerals 35 and 36 represent subtractors, and reference numerals 37 and 38 represent adders. The circuit 30 receives the measured data Q(k) of an air flow rate, for example, which is outputted from the A/D converter at a predetermined period, and outputs an estimation value $\overline{Q}(k)$.

FIG. 11 shows a delay compensation circuit (advance filter) 40 embodying the formula (6). In FIG. 11, reference numerals 41, 42 and 43 represent delay elements, reference numeral 44 represents a multiplier for multiplying an input signal by 3, and reference numerals 45 and 46 represent adders.

In the above embodiment, the estimation value $\overline{Q}(k)$ is calculated in accordance with the formula (7). However, it is generally obtained by the following formula (8):

$$\begin{aligned}\overline{Q}(k) &= Q(k) + \Delta_k + \Delta_k^2 + \Delta_k^3 + \ldots + \Delta_k^n \\ &= Q(k) + \sum_{i=1}^{n} \Delta_k^i\end{aligned} \quad (8)$$

where $$\Delta_k^n = \Delta_k^{n-1} - \Delta_{k-1}^{n-1}$$

$$\vdots$$

$$\Delta_k^i = \Delta_k^{i-1} - \Delta_{k-1}^{i-1}$$

$$\vdots$$

$$\Delta_k^2 = \Delta k - \Delta_{k-1}.$$

A more correct estimation value $\overline{Q}(k)$ can be obtained from the embodiment constituted in accordance with the above formula. The second embodiment of this invention will be described next. In the first embodiment, the estimation value $\overline{Q}(k)$ is obtained by using the formula (6) or the formula (7) based upon the criterion of formula (5). In the second embodiment, the following criterion is used:

$$\overline{Q}(k)=Q(k)+\Delta_k \quad (9)$$

The meaning of this formula is as follows. It is assumed that a change $\Delta_k$ between the measured values at a current time point and at the time point one period earlier will continue up to the (future) time after one period to thus estimate the measured value at the time point one period later, and the estimated value is regarded as the actual measured data value at the current time point. The formula (9) is changed into the following formula by using the above-defined formula (1):

$$\overline{Q}(k)=2Q(k)-Q(k-1) \quad (10)$$

Figure 1:
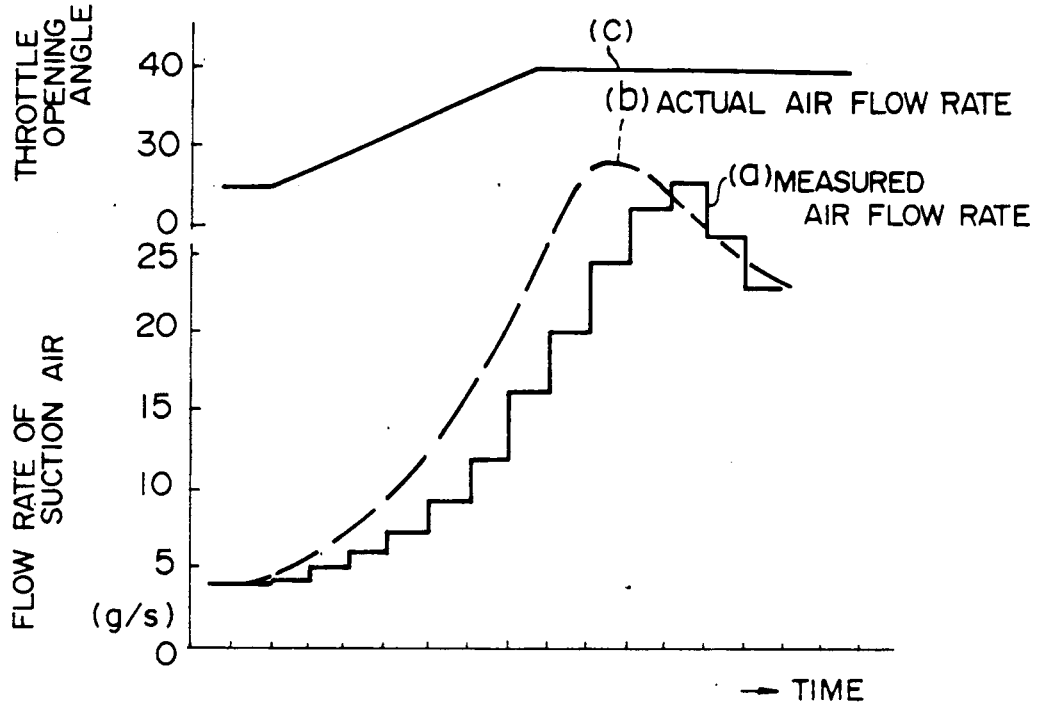
FIG. 1 PRIOR ART
FIG. 1 is a graph showing a relationship between a throttle valve opening angle and a measured air flow rate according to the prior art.
Figure 12:
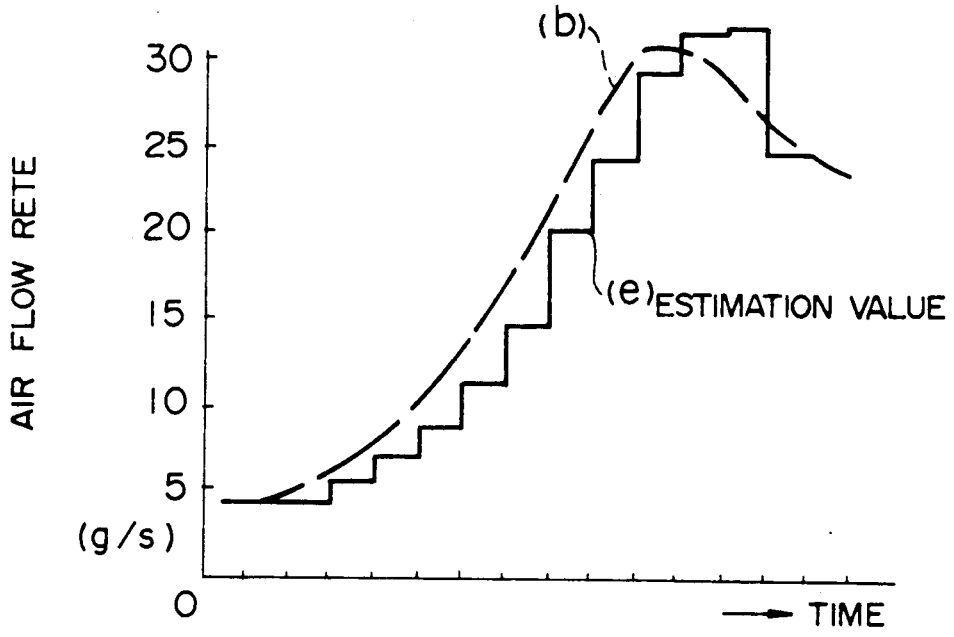
FIG. 12 is a graph showing the characteristic of an estimation value of air flow rate data, according to a second embodiment of this invention.

FIG. 12 shows the comparison between the estimation data obtained through the formulas (9) and (10) and the actual suction air flow rate, under the same condition as FIGS. 1 and 7.

In FIG. 12, a curve (b) represents an actual air flow rate, and a curve (e) represents estimation data according to this embodiment. The curve (e) shown in FIG. 12 has an air flow rate nearer to the actual air flow rate than the curve (a) shown in FIG. 1. When compared with the curve (e) shown in FIG. 7, the curve (e) shown in FIG. 12 takes somewhat a poor precision of the estimation value during the time duration following the peak of an actual air flow rate. However, since the calculation for obtaining the estimation value is simpler than that of the first embodiment, the load of the MPU can be alleviated.

Figure 13:
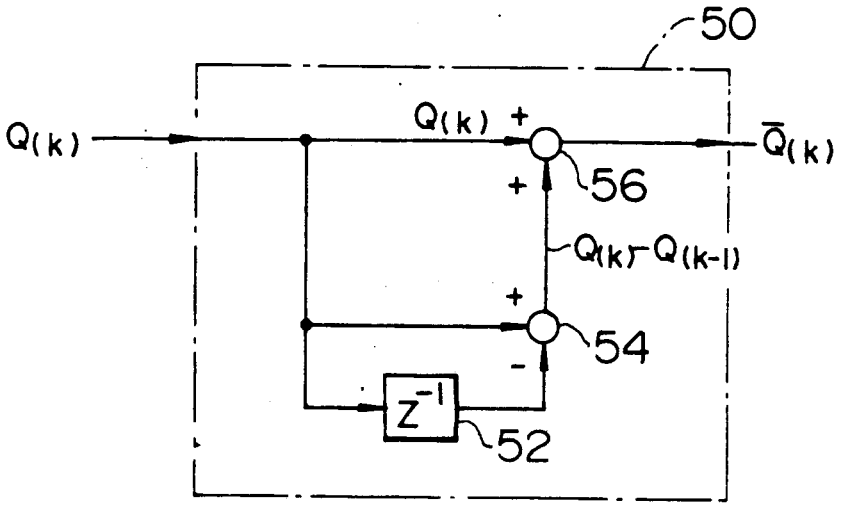
FIG. 13 is a schematic diagram of a delay compensation circuit according to the second embodiment.

In this embodiment, the data processing is carried out in accordance with programs in ROM in a similar manner to the first embodiment. The data processing of the formula (10) is realized by the circuit shown in FIG. 13 wherein reference numeral 52 represents a delay element, 54 a subtracter, and 56 an adder.

If an estimation value is obtained by using the formulae (6), (7) or (10) for the case where the waveform of air flow rate data to be measured has an overshoot, as shown by the curves (b) in FIGS. 7 and 12, the estimation value has a good precision at the rising portion of data (at the portion where the increasing rate of data is large), but a poor precision at the portion where the increasing rate of data is smaller than a predetermined value.

In consideration of the above, it is also possible that the method as described with the first and second embodiments is used for the portion where the increasing rate of measured data is larger than or equal to the predetermined value, whereas the measured data per se is used for the portion where the increasing rate of measured data is decreasing or smaller than the predetermined value.

Figure 14:
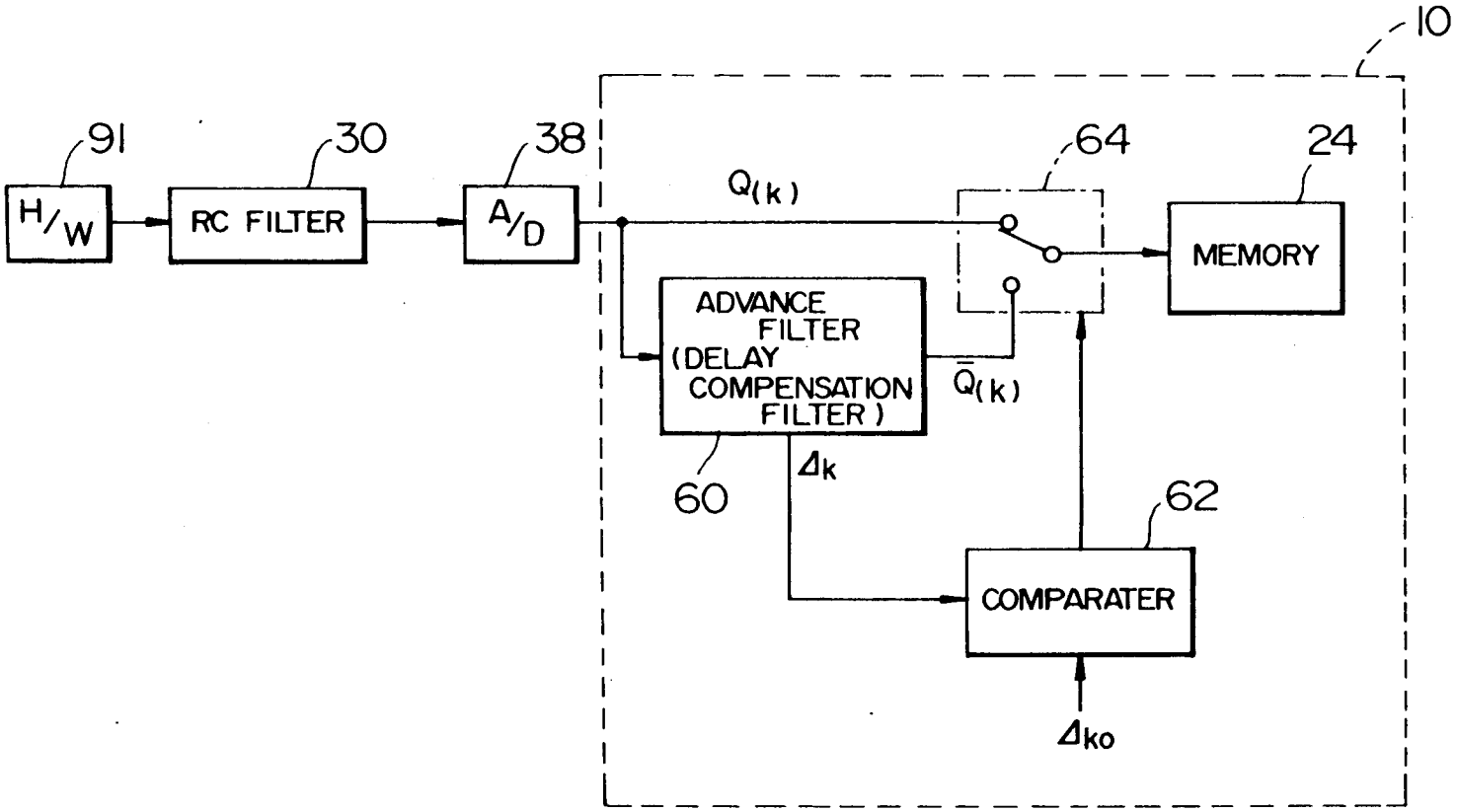
FIG. 14 is a block diagram showing a third embodiment.

A third embodiment based on the above concept is constructed as shown in FIG. 14.

In this embodiment, there is provided a switch 64 which selects either the estimation value $\overline{Q}(k)$ outputted from the delay compensation circuit of the first or second embodiment, i.e., the advance filter 60, or the measured data Q(k) of an air flow rate from the A/D converter 38. The data selected by the switch 64 is stored in a memory, e.g, RAM.

A comparator 62 compares the change amount $\Delta_k$ obtained by the advance filter 60 with a predetermined value $\Delta k_0$. The comparator 62 controls the switch 64 such that the data $\overline{Q}(k)$ is selected when $\Delta_k \geqq \Delta k_0$, and the data Q(k) is selected when $\Delta_k < \Delta k_0$.

The comparator 62 and switch 64 may be constructed of hardware within the unit 10, or may be implemented by software.

Figure 15:
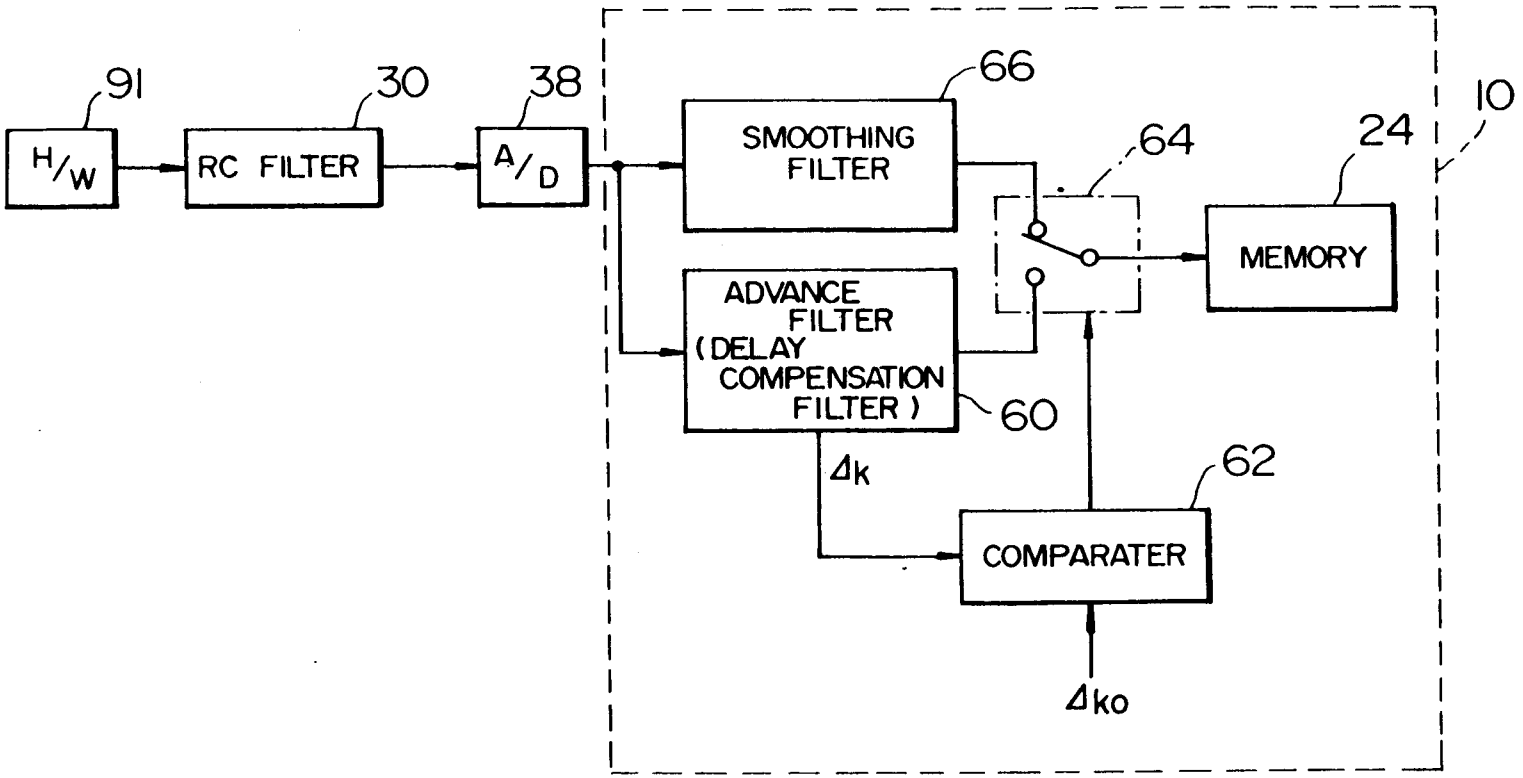
FIG. 15 is a block diagram showing a modification of the third embodiment.

FIG. 15 shows a modification of this embodiment, wherein output data from the A/D converter is supplied to the advance filter on the one hand, and is supplied on the other hand to a smoothing filter 66 for cutting a low frequency pulsation by means of weighted averaging or the like. One of the outputs is selected by a switch 64.

In the embodiments shown in FIGS. 14 and 15, the advance filter is used only for the measured data associated with a large increasing rate of an air flow rate so that the data supplied to RAM can indicate a more correct and actual air flow rate.

Next, a fourth embodiment will be described. In the first and second embodiments, an estimation value at a current time point is obtained on the assumption that the change of measured data will continue similarly up to the time point one period later, and the estimation value is used as the actual current value. However, the fourth embodiment is effective when used for the case where the delay characteristic of the device to be compensated is already known.

Compensating for a time delay of a device, e.g., the RC circuit will be described. In the step response of the RC circuit shown in FIG. 6, the time constant can be measured as the time required for the output voltage to become 63% of the final value, or may be calculated from the values of resistors and capacitors of the RC circuit.

One period during which the measured data is inputted is assumed as Δt. The measured data of an air flow rate is processed by the following formula to thereby compensate for the time delay of the RC circuit:

$$\overline{Q}(k) = Q(k) + K_T(Q(k) - Q(k-1)) \tag{11}$$

where $\overline{Q}(k)$ is an estimation value of an air flow rate at time point k. The coefficient Kt in the formula (11) is obtained by the following formula:

$$K_T = \frac{T}{\Delta t} \tag{12}$$

In this embodiment, a hardware circuit may be constructed so as to satisfy the formula (11), or the data processing may be carried out with software.

Figure 16:
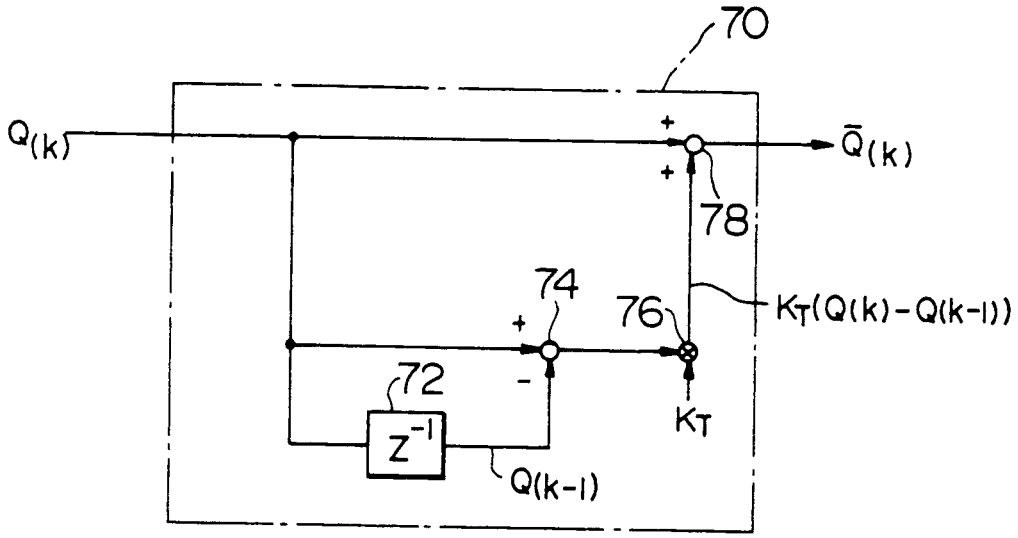
FIG. 16 is a schematic diagram of a circuit according to a fourth embodiment of this invention.

FIG. 16 shows the fourth embodiment. In FIG. 16, reference numeral 72 represents a delay element, 74 a subtractor, 76 a multiplier for multiplying the data by a coefficient Kt, and 78 an adder.

If the embodiment is realized with software, the coefficient Kt is calculated beforehand and stored in a memory (RAM or ROM) to then carry out the operation of the formula (11).

Although this embodiment compensates for a delay of the RC circuit only, this delay is large as compared with that of the sensor and AD converter so that the estimation value takes a value near the actual air flow rate.

Figure 17:
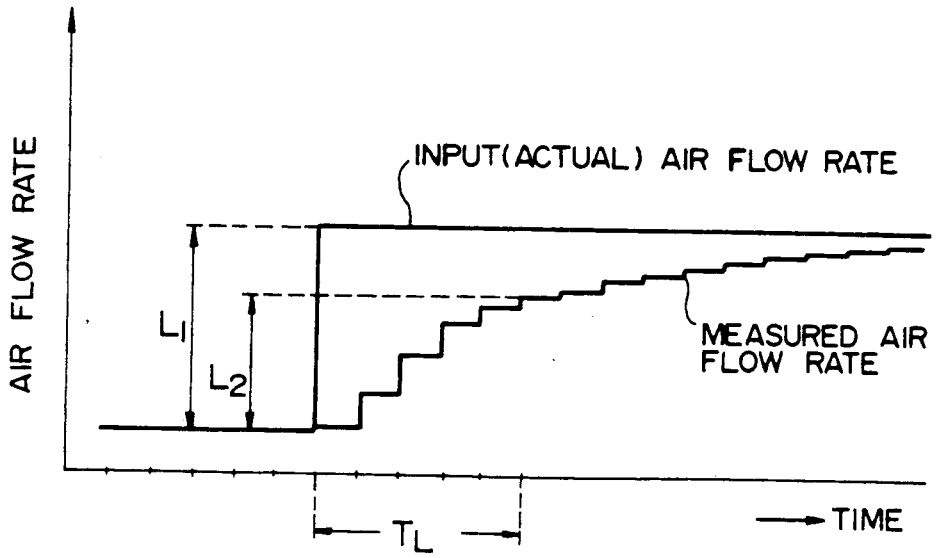
FIG. 17 is a diagram showing the characteristic of measured data of a stepwise changing air flow rate.
Figure 18A:
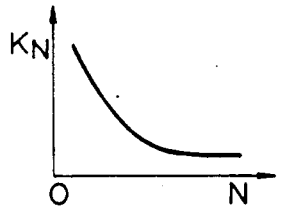
FIGS. 18A to 18D show the examples of maps used in a fifth embodiment of this invention.
Figure 18B:
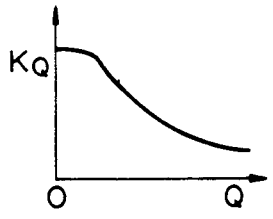
Figure 18C:
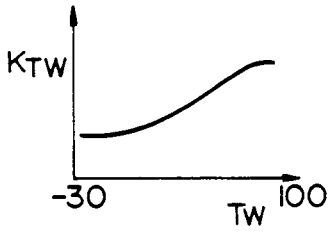
Figure 18D:
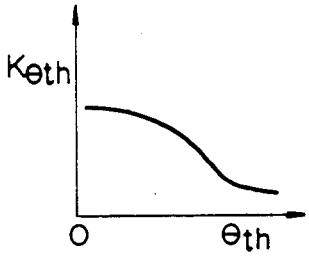

The device whose delay is compensated is the RC circuit in the above embodiment. However, another method is also possible as shown in FIG. 17 wherein a stepwise air flow is applied experimentally to obtain the response data of the air flow rate. In this case, during the course of obtaining the measured data from an stepwise changed input air flow, not only the delay at the RC circuit, but also the delay of the hot-wire type air flow meter and A/D converter are added, resulting in the step response as shown in FIG. 17.

The time when the measured air flow rate becomes 63% of the final value of the input stepwise air flow rate is represented by T1. Namely, the time constant T1 is L2/L1 in FIG. 17. By using the coefficient Kt which is represented by:

$$K_T = \frac{T_L}{\Delta t} \tag{13}$$

the delay compensation according to the formula (11) is carried out. Regarded as the primary delay system are the devices to be delay compensated, i.e., a circuit including for example the air flow sensor and RC circuits and also preferably the A/D converter. The time constant T1 of the circuit is experimentally obtained beforehand, and the coefficient is obtained by dividing it by the one period Δt as in the formula (13) which coefficient is used in obtaining the estimation value from the formula (11) to thereby realize delay compensation.

A delay compensation can be conducted as in the following fifth embodiment which is one example of an application of the fourth embodiment:

$$\overline{y}(k) = y(k) + f(N, Q, T_w, \theta th, \Delta t) \times (y(k) - y(k-1)) \tag{14}$$

where y represents an optional measured data value, N an engine revolution number, Q a suction air flow rate, Tw a cooling water temperature, θth a throttle valve opening angle, and Δt one period of time. In other words, the formula (14) uses as the coefficient Kt in the formula (11) the function f( ) of the data representative of the engine running conditions and suspension conditions.

y(k) represents the measured data value at a current time point, and y(k−1) represents the measured data value at the time point one period earlier.

Using the suction air flow rate Q as an example of the measured data y, the function f( ) is expressed for example by the following formula:

$$f(\ ) = \frac{1}{\Delta t_{(sec)}} \cdot \frac{(m/2) \cdot 60\ (\text{sec})}{N} \tag{15}$$

where m represents the number of engine cylinders.

Therefore, the estimation value is expressed as:

$$\tilde{Q}(k) = Q(k) + \frac{1}{\Delta t} \cdot \frac{(m/2) \cdot 60}{N} (Q(k) - Q(k-1)). \tag{16}$$

In obtaining the estimation value by the formula (16), the change amount Δk becomes smaller as the value N becomes larger. This means that the change rate of the suction air flow rate Q becomes larger as the vehicle runs at a lower speed.

The function f( ) may use:

$$f(\ ) = K_N,\ K_Q,\ K_{TW},\ K_{\theta th}/\Delta t \tag{17}$$

where coefficients Kn, Kq, Ktw and $K_{\theta th}$ are respectively for the values N, Q, TW and θth, which may be obtained from the maps shown in FIGS. 18A to 18D which are stored beforehand in ROM or RAM.

Figure 19:
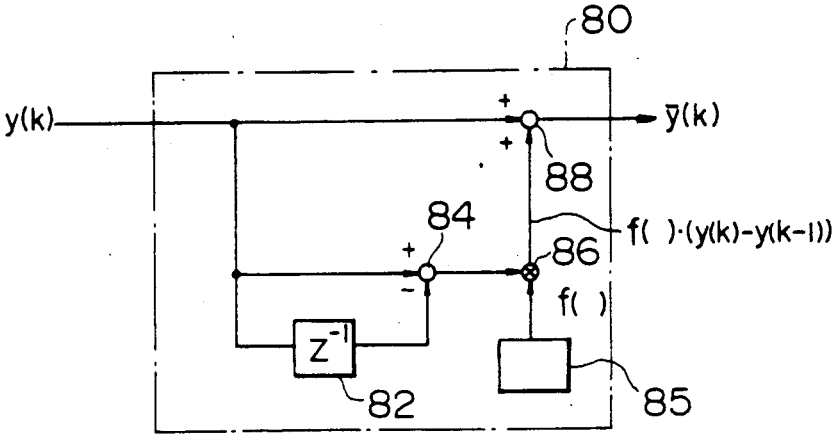
FIG. 19 is a schematic diagram of a circuit according to a fifth embodiment of this invention.

FIG. 19 shows the fifth embodiment, wherein reference numeral 85 represents a circuit for calculating a value representing the function f( ), 82 a delay element, 84 a subtractor, 86 a multiplier, and 88 an adder.

If the fifth embodiment is used with the first embodiment, the formula (5) or (6) is changed as in the following:

$$\tilde{y}(k) = y(k) + K_{T1}(y(k) - y(k-1)) + K_{T3}[K_{T1}(y(k) - y(k-1)) + K_{T2}(y(k-1) - y(k-2))] \tag{18}$$

where Kt1, Kt2, and Kt3 can be obtained from the function of data (parameters) representative of the engine and/or suspension conditions.

The third embodiment is applicable to the fourth and fifth embodiments such that delay compensation is effected only for the rising portion of measured data to be delay compensated.

Next, a sixth embodiment will be described. As described previously, noises are present in a signal measured with a hot-wire type air flow meter for various reasons. An RC circuit is used to remove such noises. In some cases, the signal is A/D converted and passed through a delay filter (e.g., smoothing filter) to smooth the pulsation of the measured data of an air flow rate.

If a device to be controlled, an engine in this case, is under an ordinary running (steady operation) condition, the measured data does not change very but a pulsation component is likely to occur. If a smoothing filter is used for removing such low frequency components, the output data from the smoothing filter indicates substantially the actual air flow rate even if the delay of the measured data is not compensated, thus posing no problem.

However, under a transient running condition, the air/fuel control characteristic relative to fuel injection control is degraded because of the delay at the smoothing filter. Also, under a transient running condition during acceleration for example, the measured data value changes greatly so that the pulsation component can be neglected relatively. Accordingly, in some cases the measured data is not required to be passed through the smoothing filter.

Figure 20:
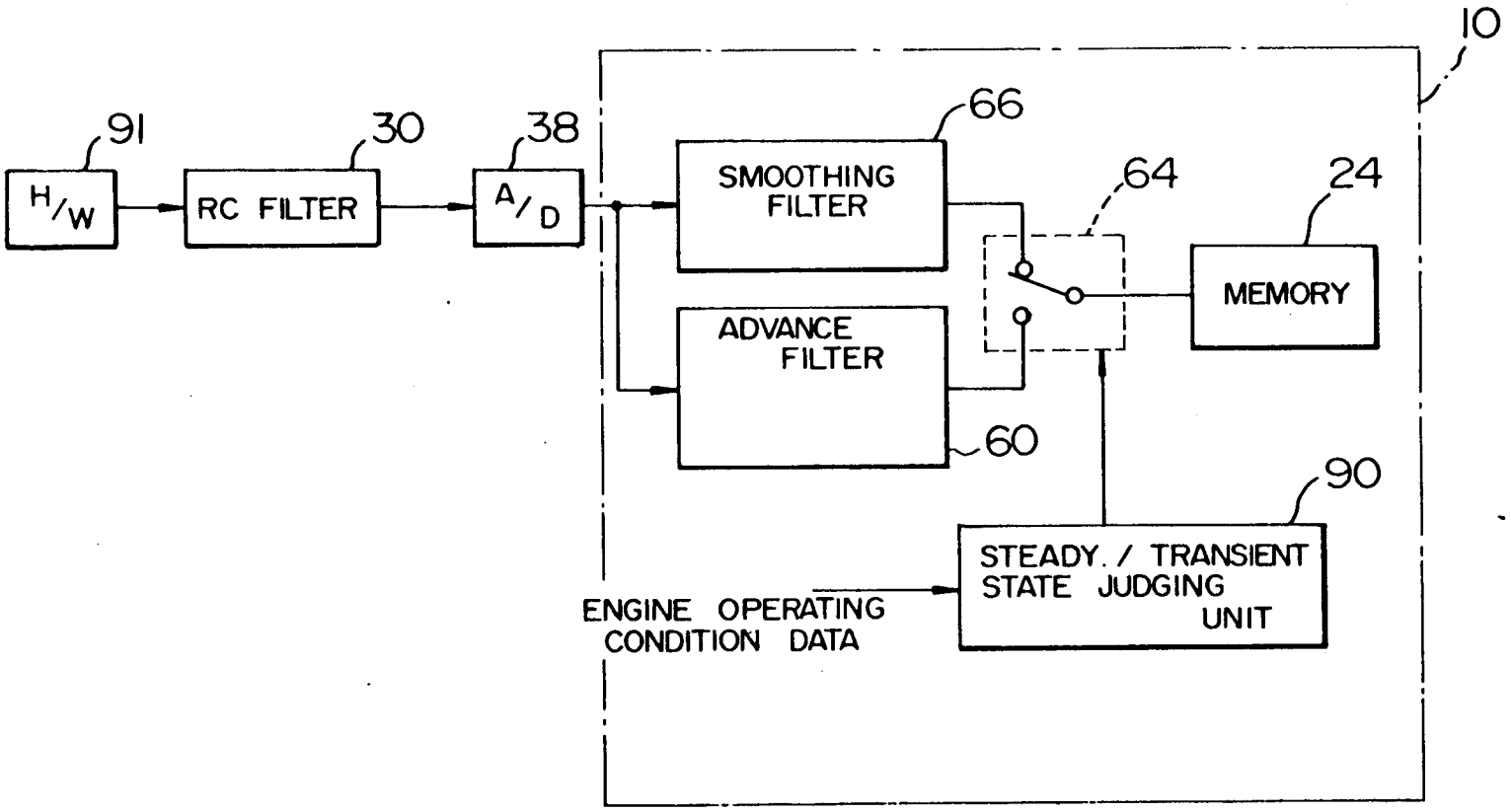
FIG. 20 is a schematic diagram of a circuit according to a sixth embodiment of this invention.

In consideration of the above, in this embodiment, the measured data is passed through the smoothing filter under an ordinary running condition, and is passed through the advance filter shown in the above embodiments instead of the smoothing filter under a transient running condition during acceleration for example. A particular example for conducting such control is shown in FIG. 20. Constitutional elements shown in FIG. 20 with identical reference numbers to those in FIG. 14 have a similar function to that described with FIG. 14. In FIG. 20, filters 60 and 66, switch 64 and discriminator unit 90 may be constructed of hardware and implemented within the I/O circuit.

The steady/transient condition discriminator unit 90 receives data representative of the engine running condition to perform the condition discrimination. For instance, it discriminates the transient running condition if the change rate of a throttle valve opening angle is larger than or equal to a certain level, and controls the switch 64 to select one of the filters 60 and 66 in the manner as described previously.

With such an arrangement, the pulsation component of the measured data can be smoothed under a steady running condition, and the delay thereof can be compensated under a transient running condition. Processing the air flow rate data obtained as above advantageously improves the air/fuel ratio control characteristic. The advance filter 60 may take the form of any one of those shown in the first, second, fourth and fifth embodiments.

Figure 21:
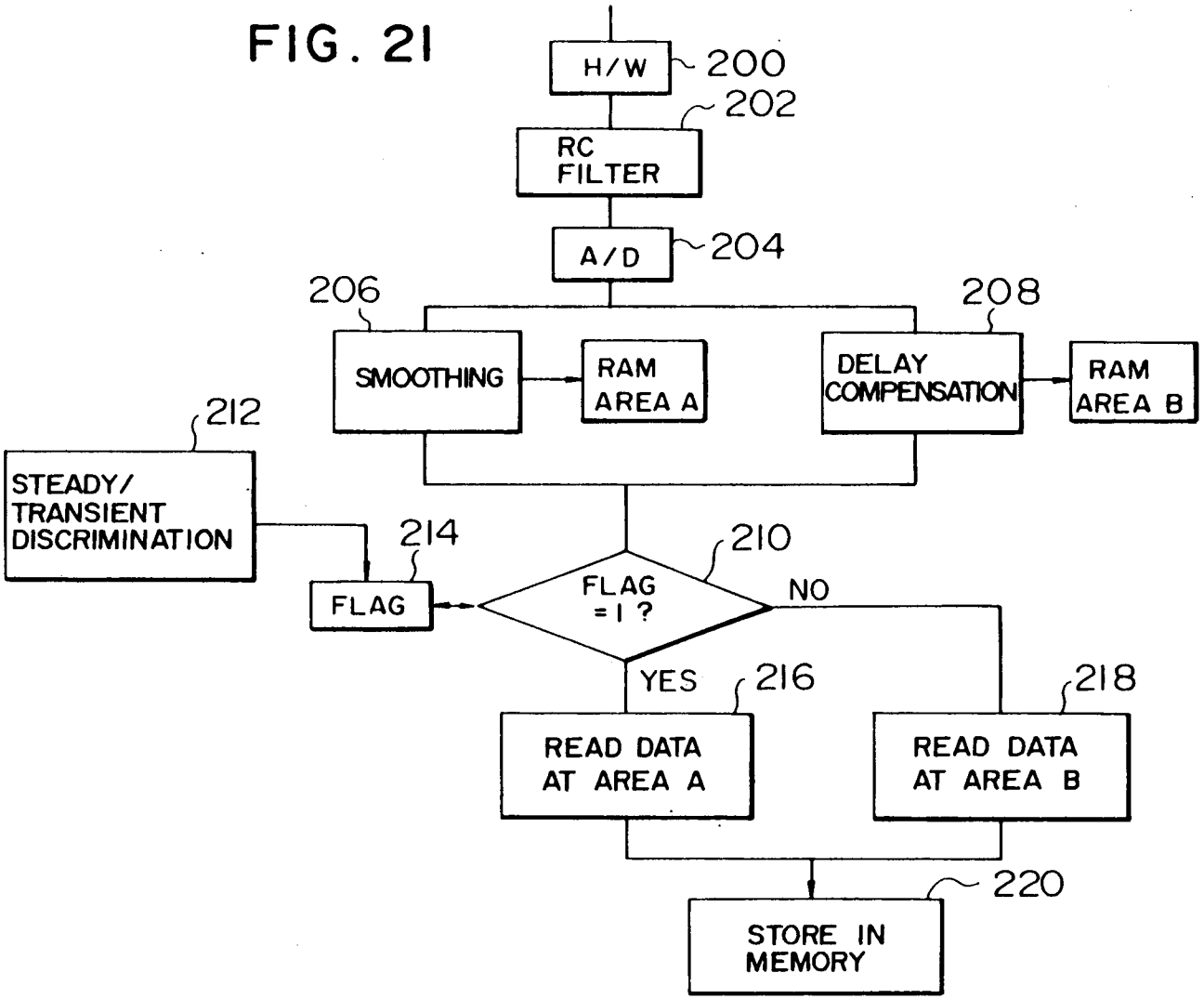
FIG. 21 is a flow chart used for explaining the operation of the sixth embodiment.

FIG. 21 shows an example of a procedure flow diagram for this embodiment wherein the operation of the filters 60 and 66, switch 64 and discriminator unit 90 is controlled in accordance with programs in ROM.

In FIG. 21, at blocks 200, 202 and 204, an air flow rate is measured by an air flow sensor, noises are removed at an RC filter, and the resultant signal is A/D converted. The A/D converted data is subjected to smoothing, such as weighted averaging, at block 206, the resultant data being stored in RAM at area A. At block 208, the A/D converted data is subjected to delay compensation in the manner as described with the foregoing embodiments and stored in RAM at area B.

At block 212, the engine running condition is discriminated to determine whether it is a transient condition or a steady condition. Upon discrimination, a flag "0" for the transient condition or a flag "1" for the steady condition is set in RAM at a predetermined area (block 214).

At block 210, the flag is checked. In the case of a flag "1", data in RAM at area A is read (block 216) and set at block 220 in RAM at a predetermined area for data processing. In the case of a flag "0", data at area B is read (block 218) and set in RAM at a predetermined area.

In the above embodiment, the discriminator unit discriminates if the engine running condition is a steady condition or a transient condition. However, if the measured data is for the dumper stroke position signal, the discriminator unit discriminates if the suspension condition is a steady condition or a transient condition to accordingly control the switch 64. Namely, the transient condition is discriminated if the dumper stroke position changes greatly, to then select the advance filter.

In the above embodiments, the method of processing mainly air flow rate data has been described. However, the invention is applicable to all data inputted to a microcomputer mounted on an automobile. For instance, various data to be processed includes the input data to an electric control apparatus for control of an engine, which include a throttle angle signal, accelerator angle signal, air/fuel ratio signal, suction tube pressure signal, cooling water temperature signal, suction air temperature signal, revolution number signal, knocking signal and the like.

The data to be processed includes also output data from a dumper stroke sensor supplied for control of the oil pressure control apparatus 19 which regulates the oil pressure of a suspension, and other data.

Further, in the above embodiments, a predetermined time duration is used as one period for the case where an air flow rate is used as the measured data. However, a predetermined time duration or predetermined rotary angle range may be used as one period for the case where other types of measured data are used.

As described so far in detail, according to the present invention, in an electric control apparatus for an engine, suspension or the like mounted on a vehicle, the measured data is subjected to an advance filter to compensate for a time delay of the measured data. Accordingly it becomes possible to provide a simple method and apparatus for compensating for a time delay of measured data, thereby effectively improving the control performance.

Figure 22:
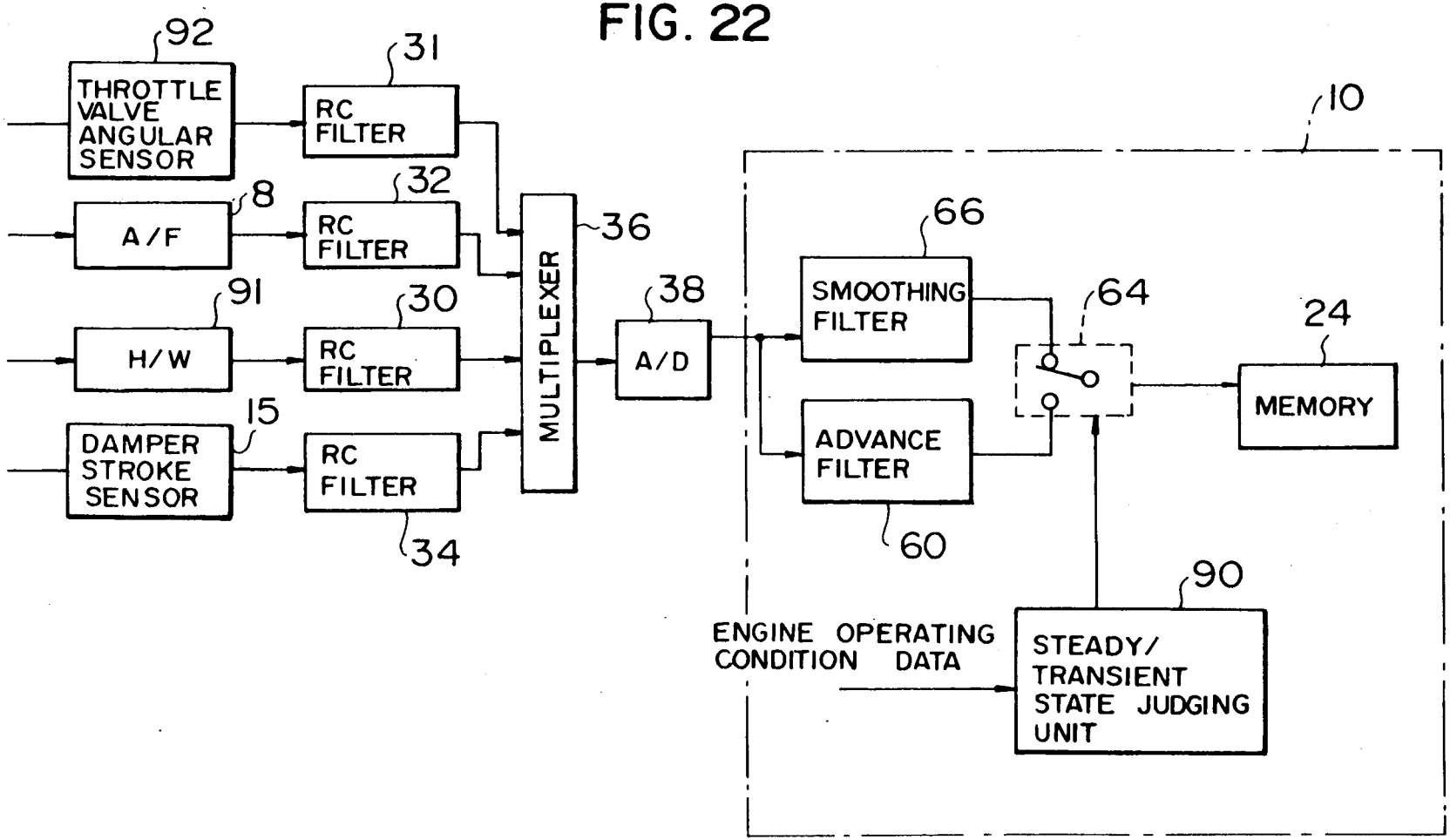
FIG. 22 is a schematic diagram of representing a circuit of a modification of the sixth embodiment.

Further, in the above embodiments, a delay compensation for one type of measured data has been described. However, as shown in FIG. 4, a delay compensation processing may be simultaneously carried out for other output data from the throttle valve angle sensor 92, air/fuel ratio sensor 8, dumper stroke position sensor 15 or the like. In such a case, in the third and sixth embodiments, the outputs from the sensors are sequentially selected by the multiplexer 36, A/D converted and thereafter, passed through one of the filters 60 and 66. FIG. 22 shows an example of a modification of the sixth embodiment, as constructed in accordance with the above arrangement.

We claim:

1. An electric control apparatus for electrically controlling a controllable device mounted on an automobile, comprising:

measuring means for producing output data values representing at least one state of the controllable device;

memory means for storing successive output data values of said measuring means;

calculation means for calculating at a current time point an estimation value representing said one state of said controllable device at a future time point on the basis of an output data value of said measuring means at a current time point and at least one output data value previously stored in said memory means; and operating processing means for calculating at least one control value to be applied at a current time point to said controllable device on the basis of the estimation value from said calculation means; wherein said memory means includes means for storing successive output data values received periodically from said measuring means; and said calculation means includes means of reading out at least one output data value previously stored in said memory means and for calculating at least one changing value of the output data values of said measuring means on the basis of the read-out output data value and an output data value stored at a current time point from said measuring means to thereby calculate the estimation value on the basis of the output data value stored at the current time point and the changing value, means for reading out an output data value stored in said memory means one period before and for calculating a difference value between the output data value stored at the current time point and the read-out output value to thereby calculate the estimation value on the basis of the output data value at the current time point and the difference value, and means for obtaining the estimation value representing said one state at one period after adding the output data value stored at the current time point to the difference value.

2. An electric control apparatus for electrically controlling a controllable device mounted on an automobile, comprising:

measuring means for producing output data values representing at least one state of the controllable device;

memory means for storing successive output data values of said measuring means;

calculation means for calculating at a current time point an estimation value representing said one state of said controllable device at a future time point on the basis of an output data value of said measuring means at a current time point and at least one output data value previously stored in said memory means; and operating processing means for calculating at least one control value to be applied to said controllable device on the basis of the estimation value from said calculation means;

wherein said calculation means includes means for calculating a first difference value between the output data value stored at the current time point and the output data value stored one period before and a second difference value between the output data values stored one and two periods before to thereby calculate the estimation value on the basis of the first and second difference values and the output data value stored in the current time point, and means for calculating a third difference value between the first and second difference values and for calculating the sum of the output data value stored at the current time point and a difference value between the first and third difference values to thereby obtain an estimation value representing said state at one period after.

3. An electric control apparatus for electrically controlling a controllable device mounted on an automobile, comprising:

measuring means for producing output data values representing at least one state of the controllable device;

memory means for storing successive output data values of said measuring means;

calculation means for calculating at a current time point an estimation value representing said one state of said controllable device at a future time point on the basis of an output data value of said measuring means at a current time point and at least one output data value previously stored in said memory means; and operating processing means for calculating at least one control value to be applied at a current time point to said controllable device on the basis of the estimation value from said calculation means;

wherein said memory means includes means for storing successive output data values received periodically from said measuring means and for storing a coefficient proportional to a time constant of a step response of said measuring means; and said calculation means includes means for reading out at least one output data value previously stored in said memory means and for calculating at least one changing value of the output data values of said measuring means on the basis of the read-out output data value and an output data value stored at a current time point from said measuring means to thereby calculate the estimation value on the basis of the coefficient, the output value stored at the current time point and the changing value.

4. An electric control apparatus according to claim 3, wherein said calculating means includes means for reading out the coefficient and an output data value stored in said memory means one period before and for calculating a difference value between the output data value stored at the current time point and the read-out output value to thereby calculate the estimation value on the basis of the output data value at the current time point, the difference value and the coefficient.

5. An electric control apparatus according to claim 4, wherein said calculating means includes means for obtaining the estimation value representing said one state at one period after by adding the output data value stored at the current time point to the difference value multiplied by the coefficient.

6. An electric control apparatus according to claim 5, wherein said coefficient is the time constant divided by a time equal to the one period.

7. An electric control apparatus according to claim 6, wherein said measuring means includes at least one sensor for producing output data values representing at least one state of the controllable device and a primary delay filter for filtering an output signal from the sensor to output the output data value, and said time constant is a time constant for a step response of the primary delay filter.

8. An electric control apparatus according to claim 6, wherein said measuring means includes at least one sensor for producing output data values representing at least one state of the controllable device and a primary delay filter for filtering an output signal from the sensor to output the output data value, and said time constant is a time constant for a step response of the sensor and the primary delay filter.

9. An electric control apparatus for electrically controlling a controllable device mounted on an automobile, comprising:

measuring means for producing output data values representing at least one state of the controllable device;

memory means for storing successive output data values of said measuring means;

calculation means for calculating at a current time point an estimation value representing said one state of said controllable device at a future time point on the basis of an output data value of said measuring means at a current time point and at least one output data value previously stored in said memory means; and operating processing means for calculating at least one control value to be applied at a current time point to said controllable device on the basis of the estimation value from said calculation means;

detecting means for detecting a data value representing at least another state of the controllable device; and generating means for generating at least one value produced from a function representing the state of the controllable device on the basis of the detection data value of the detecting means; wherein said memory means includes means for storing successive output data values received periodically from said measuring means; and said calculation means includes means for reading out at least one output data value previously stored in said memory means and for calculating at least one changing value of the output data values of said measuring means on the basis of the read-out output data value and an output data value stored at a current time point from said measuring means to thereby calculate an estimation value on the basis of the output data value stored at the current time point, the changing value, and the value produced from the function.

10. An electric control apparatus according to claim 9, wherein said calculation means includes means for reading out an output data value stored in said memory means one period before, for calculating a difference value between the output data value stored at the current time point and the read-out output value, and for adding the output data value at the current time point to the difference multiplied by the value produced from the function to thereby obtain the estimation value representing the state at one period after.

11. An electric control apparatus according to claim 9, wherein said generating means includes means for generating first and second values produced from respective first and second functions representing the state of the controllable device on the basis of the detection data value of the detecting means; wherein said calculating means includes means for calculating a first difference value between the output data value stored at the current time point and the output data value stored one period before and a second difference between the output data values stored one and two periods before and for producing an estimation value representing the state at one period after by adding the product of the second difference and the value produced from the second function to the output data value stored at the current time point.

12. An electric control apparatus according to claim 9, wherein the at least another state of the controllable device is a running condition of an automobile engine.

13. An apparatus for electrically controlling a controllable device mounted on an automobile, comprising:

measuring means for producing output data values representing at least one state of said controllable device mounted on the automobile;

filter means for filtering output data values from said measuring means;

memory means for storing successive output data values of said measuring means;

calculating means for calculating at a current time point an estimation value representing said one state of said controllable device at a future time point on the basis of an output data value of said measuring means at a current time point and at least one output data value previously stored in said memory means;

judging means for judging whether the state of said controllable device is in either one of a first state and a second state based on operating condition data;

selecting means for selecting one of the estimation value and the filtered output data value from said calculating means and said filter means in accordance with the result of said judging means; and operation processing means for calculating a control value on the basis of the selected output of said selecting means and applying a control signal representing the control value to said controllable device.

14. An apparatus according to claim 13, wherein said judging means includes means for judging as the first and second states whether the state of said controllable device is a transient state or a steady state, and said selecting means includes means for selecting said estimation value from said calculating means when said judging means judges the state as the transient state and selecting the filtered output data value from said filter means when said judging means judges the state as the steady state.

15. An apparatus according to claim 14, further comprising:

detecting means for detecting a data value representing at least another state of the controllable device; and generating means for generating at least one value produced from a function representing the state of the controllable device on the basis of the detection data value of the detecting means; wherein said memory means includes means for storing successive output data values received periodically from said measuring means; and said calculating means includes means for reading out at least one output data value previously stored in said memory means and for calculating at least one changing value of the output data values of said measuring means on the basis of the read-out output data value and an output data value stored at a current time point from said measuring means to thereby calculate an estimation value on the basis of the output data value stored at the current time point, the changing value, and the value produced from the function.

16. An electric control apparatus according to claim 15, wherein said calculating means includes means for reading out an output data value stored in said memory means one period before, for calculating a difference value between the output data value stored at the current time point and the read-out output value, and for adding the output data value at the current time point to the difference multiplied by the value produced from the function to thereby obtain the estimation value.

17. An apparatus according to claim 10, wherein said memory means includes means for storing successive output data values received periodically from said measuring means and for storing a coefficient proportional to a time constant of a step response of said measuring means; and said calculating means includes means for reading out at least one output data value previously stored in said memory means and for calculating at least one changing value of the output data values of said measuring means on the basis of the read-out output data value and an output data value stored at a current time point from said measuring means to thereby calculate the estimation value on the basis of the coefficient, the output value stored at the current time point and the changing value.

18. An apparatus according to claim 17, wherein said calculating means includes means for reading out the coefficient and an output data value stored in said memory means one period before and for calculating a difference value between the output data value stored at the current time point and the read-out output value to thereby obtain the estimation value by adding the output data value at the current time point to the difference value multiplied by the coefficient.

19. An apparatus according to claim 13, wherein said judging means includes means for judging as the first state when the output data value of said measuring means is increasing at a ratio equal to or larger than a predetermined ratio, and as the second state when the output data value is increasing at a ratio smaller than the predetermined ratio, and said selecting means includes means for selecting the outputs of said calculating means and said filter means, respectively when said judging means judges as the first and second states.

20. An apparatus according to claim 19, wherein said memory means includes means for storing successive output data values received periodically from said measuring means; and said calculating means includes means for reading out at least one output data value previously stored in said memory means and for calculating at least one changing value of the output data values of said measuring means on the basis of the read-out output data value and an output data value stored at a current time point from said measuring means to thereby calculate the estimation value on the basis of the output data value stored at the current time point and the changing value.

21. An apparatus according to claim 20, wherein said calculating means includes means for reading out an output data value stored in said memory means one period before and for calculating a difference value between the output data value stored at the current time point and the read-out output value to thereby calculate the estimation value by adding the output data value at the current time point to the difference value.

22. An apparatus according to claim 20, wherein said calculating means includes means for reading out output data values stored in said memory means one and two periods before, and means for calculating a first difference value between the output data value stored at the current time point and the output data value stored one period before, a second difference between the output data values stored one and two periods before, and a third difference value between the first and second difference values and for calculating the sum of the output data value stored at the current time point and a difference value between the first and third difference values to thereby obtain an estimation value representing said state at one period after.

23. An electrical control apparatus for electrically controlling a controllable device mounted on an automobile comprising:

measuring means for producing output data values representing at least one state of said controllable device mounted on the automobile;

memory means for storing successive output data of said measuring means;

calculating means for calculating at a current time point an estimation value representing said one state of said controllable device at a future time point on the basis of an output data value of said measuring means at a current time point and at least one output data value previously stored in said memory means; and operation processing means for calculating a control value on the basis of the estimation value and applying a control signal representing the control value to said controllable device; wherein said memory means includes means for storing successive output data values received periodically from said measuring means; and said calculating means includes means for reading out at least one output data value previously stored in said memory means and for calculating at least one changing value of the output data values of said measuring means on the basis of the read-out output data value and an output data value stored at a current time point from said measuring means to thereby calculate the estimation value on the basis of the output data value stored at the current time point and the changing value, and means for reading out an output data value stored in said memory means one period before and for calculating a difference value between the output data value stored at the current time point and the read-out output value to thereby calculate the estimation value on the basis of the sum of the output data value at the current time point and the difference value.

24. An apparatus electrically controlling a controllable device mounted on an automobile comprising:

measuring means producing output data values representing at least one state of said controllable device mounted on the automobile;

memory means for storing successive output data of said measuring means;

calculating means for calculating at a current time point an estimation value representing said one state of said controllable device at a future time point on the basis of an output data value of said measuring means at a current time point and at least one output data value previously stored in said memory means; and operation processing means for calculating a control value on the basis of the estimation value and applying a control signal representing the control value to said controllable device; wherein said memory means includes means for storing successive output data values received periodically from said measuring means; and said calculating means includes means for reading out at least one output data value previously stored in said memory means and for calculating at least one changing value of the output data values of said measuring means on the basis of the read-out output data value and an output data value stored at a current time point from said measuring means to thereby calculate the estimation value on the basis of the output data value stored at the current time point and the changing value, means for reading out output data values stored in said memory means one and two periods before and for calculating the estimation value on the basis of the read-out output data values and the output data value stored at the current time point, and means for calculating a first difference value between the output data value stored at the current time point and the output data value stored one period before, a second difference between the output data values stored one and two periods before, and a third difference value between the first and second difference values and for calculating the sum of the output data value stored at the current time point and a difference value between the first and third difference values to thereby obtain an estimation value.

25. A method of controlling a controllable device mounted on an automobile which has measuring means for measuring a data value representing at least one state of said controllable device mounted on the automobile, memory means for storing successive output data values of said measuring means and operation processing means for calculating at least one control value to be applied to said controllable device on the basis of output data values of said measuring means, comprising:

a first step of reading out at least one output data value previously stored in said memory means;

a second step of calculating at a current time point an estimation value representing said one state of said controllable device at a future time point on the basis of an output data value of said measuring means at a current time point and the output data value read out from said memory means;

a third step of calculating in said operation processing means the control value on the basis of the estimation value and for applying a control signal representing the control value to said controllable device; and a fourth step of storing successive output data values received periodically from said measuring means in said memory means; wherein said second step reads out at least one output data value previously stored in said memory means, calculates at least one changing value of the output data values of said measuring means on the basis of the read-out output data value and an output data value stored at a current time point from said measuring means, to thereby calculate the estimation value on the basis of the output data value stored at the current time point and the changing value, reads out output data values stored in said memory means one and two periods before, calculates the estimation value on the basis of the read-out output data values and the output data value stored at the current time point, calculates a first difference value between the output data value stored at the current time point and the output data value stored one period before, a second difference between the output data values stored one and two periods before, and a third difference value between the first and second difference values, and calculates the sum of the output data value stored at the current time point and a difference value between the first and third difference values to thereby obtain an estimation value representing said state at one period after.

26. A method of controlling a controllable device mounted on an automobile which has measuring means for measuring a data value representing at least one state of said controllable device mounted on the automobile, emory means for storing successive output data values of said measuring means and operation processing means for calculating at least one control value to be applied to said controllable device on the basis of output data values of said measuring means, comprising:

a first step of reading out at least one output data value previously stored in said memory means;

a second step of calculating at a current time point an estimation value representing said one state of said controllable device at a future time point on the basis of an output data value of said measuring means at a current time point and the output data value read out from said memory means;

a third step of calculating in said operation processing means the control value on the basis of the estimation value and for applying a control signal representing the control value to said controllable device; and a fourth step of storing successive output data values received periodically from said measuring means in said memory means and storing a coefficient proportional to a time constant of a step response of said measuring means; and wherein said second step reads out at least one output data value previously stored in said memory means and calculates at least one changing value of the output data values of said measuring means on the basis of the read-out output data value and an output data value stored at a current time point from said measuring means to thereby calculate the estimation value on the basis of the coefficient, the output value stored at current time point and the changing value.

27. A method of controlling a controllable device mounted on an automobile which has measuring means for measuring a data value representing at least one state of said controllable device mounted on the automobile, memory means for storing successive output data values of said measuring means and operation processing means for calculating at least one control value to be applied to said controllable device on the basis of output data values of said measuring means, comprising:

a first step of reading out at least one output data value previously stored in said memory means;

a second step of calculating at a current time point an estimation value representing said one state of said controllable device at a future time point on the basis of an output data value of said measuring means at a current time point and the output data value read out from said memory means;

a third step of calculating in said operation processing means the control value on the basis of the estimation value and for applying a control signal representing the control value to said controllable device; and a fourth step of detecting a data value representing at least another state of the controllable device;

a fifth step of generating at least one value produced from a function representing the state of the controllable device on the basis of the detection data value of the detecting means; and a sixth step of storing successive output data values received periodically from said measuring means into said memory means; wherein said second step reads out at least one output data value previously stored in said memory means and calculates at least one changing value of the output data values of said measuring means on the basis of the read-out output data value and an output data value stored at a current time point from said measuring means to thereby calculate the estimation value on the basis of the output data value stored at the current time point, the changing value, and the value produced from the function.

* * * * *